US009398992B1

(12) United States Patent
Jansen

(10) Patent No.: US 9,398,992 B1
(45) Date of Patent: Jul. 26, 2016

(54) PRESSURE FREE FACE REST

(71) Applicant: Kathleen Suzanne Jansen, Apalachicola, FL (US)

(72) Inventor: Kathleen Suzanne Jansen, Apalachicola, FL (US)

( * ) Notice: Subject to any disclaimer, the term of this patent is extended or adjusted under 35 U.S.C. 154(b) by 0 days.

(21) Appl. No.: 14/696,583

(22) Filed: Apr. 27, 2015

Related U.S. Application Data

(60) Provisional application No. 62/005,091, filed on May 30, 2014.

(51) Int. Cl.

| | |
|---|---|
| ***A47G 9/10*** | (2006.01) |
| ***A47C 7/38*** | (2006.01) |
| ***A61G 13/12*** | (2006.01) |
| ***A61G 13/00*** | (2006.01) |

(52) U.S. Cl.
CPC ..... *A61G 13/121* (2013.01); *A47G 9/1009* (2013.01); *A47G 9/1054* (2013.01); *A61G 13/009* (2013.01); *A47C 7/383* (2013.01); *A61G 2200/325* (2013.01)

(58) Field of Classification Search
CPC ..... A47G 9/10; A47G 9/1009; A47G 9/1054; A47C 7/383; A47C 7/38
USPC ..... 5/638, 637, 636, 643, 622
See application file for complete search history.

(56) References Cited

U.S. PATENT DOCUMENTS

| | | | | | |
|---|---|---|---|---|---|
| 278,361 | A * | 5/1883 | Prescott | 5/640 |
| 808,217 | A * | 12/1905 | Reich | 5/640 |
| 1,098,236 | A * | 5/1914 | Duckworth | 5/640 |
| 1,211,871 | A * | 1/1917 | Peoples | 5/640 |
| 2,197,343 | A * | 4/1940 | Marx | 5/640 |
| 2,502,752 | A * | 4/1950 | Richards | 5/640 |
| 2,551,388 | A * | 5/1951 | Nygard | 5/640 |
| 2,574,590 | A * | 11/1951 | Ross | 5/656 |
| 2,695,415 | A * | 11/1954 | Holton | 5/655 |
| 2,703,890 | A * | 3/1955 | Rinaldy | 5/636 |
| 3,002,201 | A * | 10/1961 | Nelson et al. | 5/640 |
| 3,403,413 | A * | 10/1968 | Calhoun et al. | 5/638 |
| 4,544,203 | A * | 10/1985 | Younger et al. | 297/391 |
| 4,828,321 | A * | 5/1989 | Harper | 297/391 |
| 4,922,558 | A * | 5/1990 | Porco | 4/523 |
| 5,033,138 | A * | 7/1991 | Hong | 5/636 |
| 5,337,429 | A * | 8/1994 | Tucker | 5/643 |
| 6,052,849 | A * | 4/2000 | Dixon et al. | 5/643 |
| 6,839,927 | B1 * | 1/2005 | Crane | 5/643 |
| 7,676,867 | B2 * | 3/2010 | De Laura | 5/622 |
| 2008/0271248 | A1 * | 11/2008 | DeLaura | 5/638 |

* cited by examiner

*Primary Examiner* — Robert G Santos

(57) ABSTRACT

The Pressure Free Face Rest is a device designed for any standard professional massage table to hold a clients face suspended/free of any frame while in the prone position (lying face down). The Frame is wider and The Insert Rods can be adjusted through snap locks to extend for shorter or longer necks. The Face Hammock should be able to hold faces allowing them to flex much like that of a face mask. The holes for the eyes, nose, mouth are very similar to that of a standard face mask. The mask hooks into the frame like a hammock creating the feeling of suspension. By doing this we remove the pain and pressure commonly felt by the standard design on the market today.

5 Claims, 5 Drawing Sheets

PRESSURE FREE FACE REST

BACKGROUND OF INVENTION

I was working on massage clients from all over the country visiting a tourist area in Northern Florida over five years ago (10 years into my professional practice as a licensed massage therapist) and noticed the one negative theme or complaint was centered around the uncomfortable reactions to massage table face rests. People seemed to almost hate them and a few even refused to put their head down in the "hole". That's when I began looking into different designs or solutions for this and thinking of different ways this could work. So, I found the original adjustable face rest from 2002 patent #6397414 and noticed nothing had been manufactured differently. All companies who create the market were using this design. Their main design for face rests was through cushions or foam pads which were then connected through Velcro. I noticed these would wear out and people's faces started sliding down into the wood or metal frame causing a lot of discomfort even when adjusting the angle. That's when the light bulb went off! I thought with my experience I could design this better and help the industry I love; massage therapy. I started thinking of a hammock for the face instead of lying on a cushion and this is where the journey to invent began. In addition, being a scuba diver made me think of something strong yet pliable and this is where I got the idea for possible material to use for the face hammock design.

BRIEF SUMMARY OF INVENTION

Pressure-Free Face Rest is a device used to minimize pressure, discomfort, pain and sinus congestion during massage therapy services while client is in a prone (on stomach) position on a massage table or chair. Massage therapy sessions last 1 hr.-90 min. Usually a minimum of 30 minutes prone. The head and face needs support without being placed against something hard in order to be in this prone position for that length of time comfortably. My Pressure-Free Face rest model will fix this problem and this is how: The Frame will not be felt through the pads. There is flex in this design for a person's face to feel "suspended" with no metal or wood to push against the forehead, cheeks or sinuses. This will allow the person to feel more comfort and relax more deeply. There is no other design for this usage at this time. The weight being transferred from the therapist into the persons back during prone massage will be placed into the frame itself and the suspended "Face Hammock" will simply flex but the client will not feel contact with the frame. This is critically important as a receiver and the purpose of the invention.

All current models and makes of massage tables or massage chairs can replace the old face rest with this new model. Important: The Frame and Face Hammock Cover needs to be manufactured to fit the insert rod openings. Note: Some insertion distances vary for the frame among different manufacturers. This could be accommodated by each manufacturer who purchases the use of this utility patent design.

DETAILED DESCRIPTION OF DRAWINGS

Figure 1:
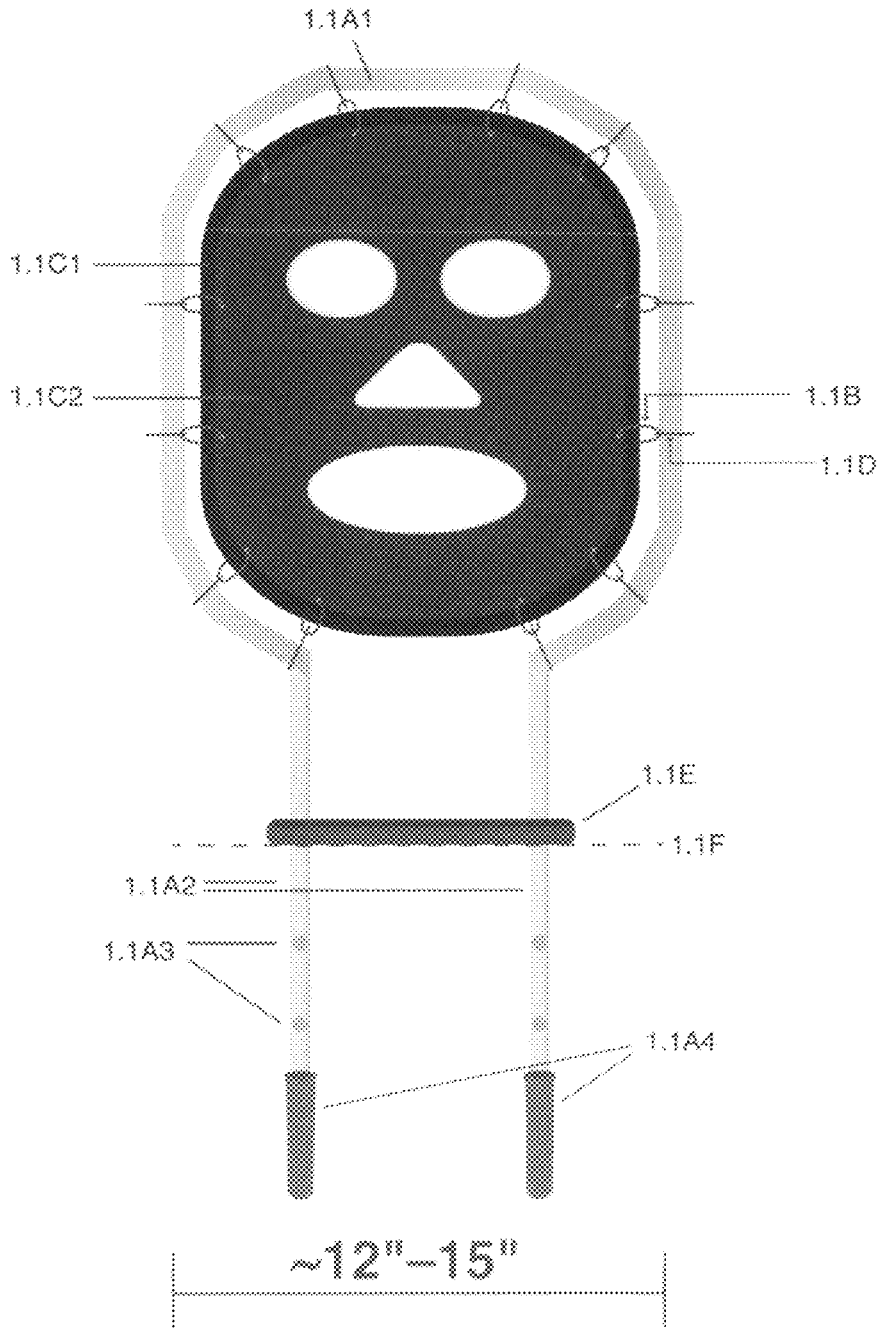
FIG. 1: Is a top view of a pressure free face rest comprising of a face/head element made of a flexible fabric layer like scuba material but not limited, comprising cut outs that form the massage therapy clients face like that of a face mask and would accommodate the holes for the eyes, nose and mouth.
Figure 2:
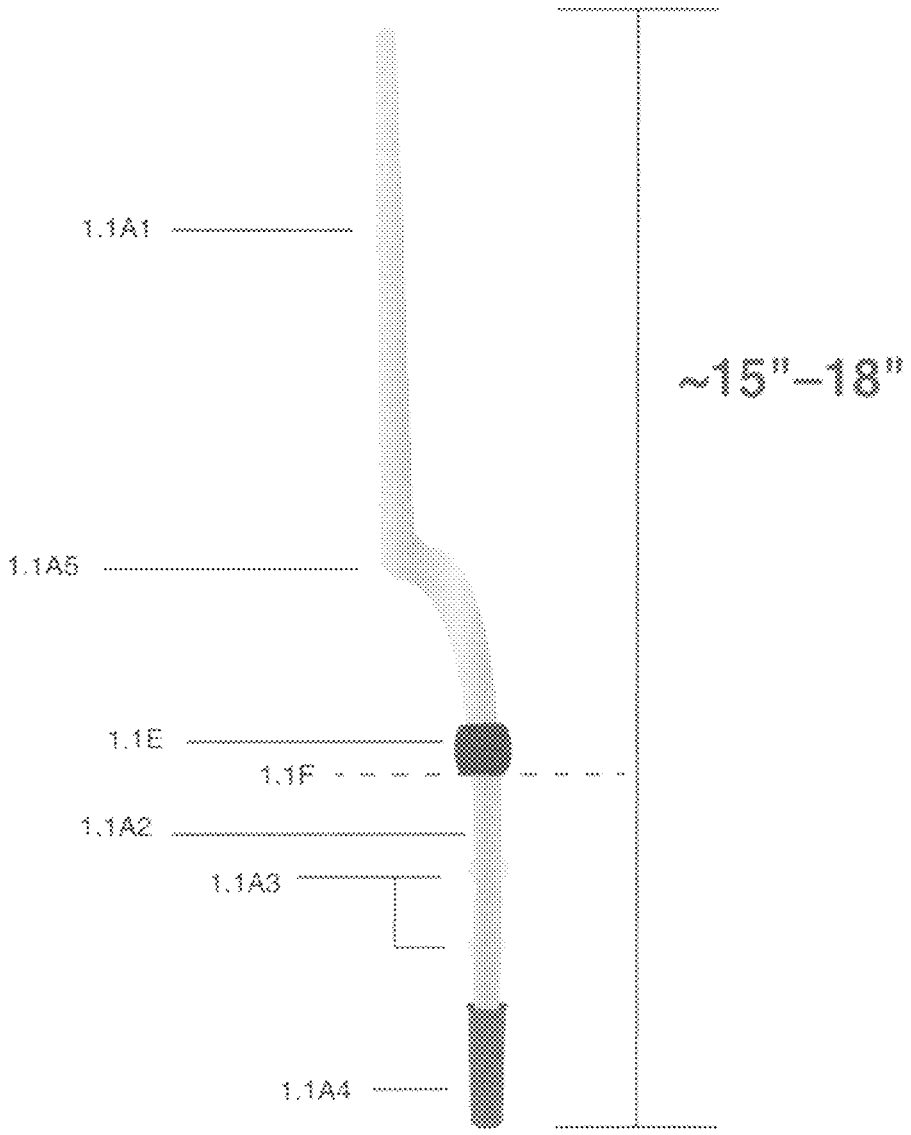
FIG. 2: Is a lateral view for further perspective of pressure free face rest frame comprising of a C-shaped opening, angle, its length and adjustable mechanisms snap/lock.
Figure 3:
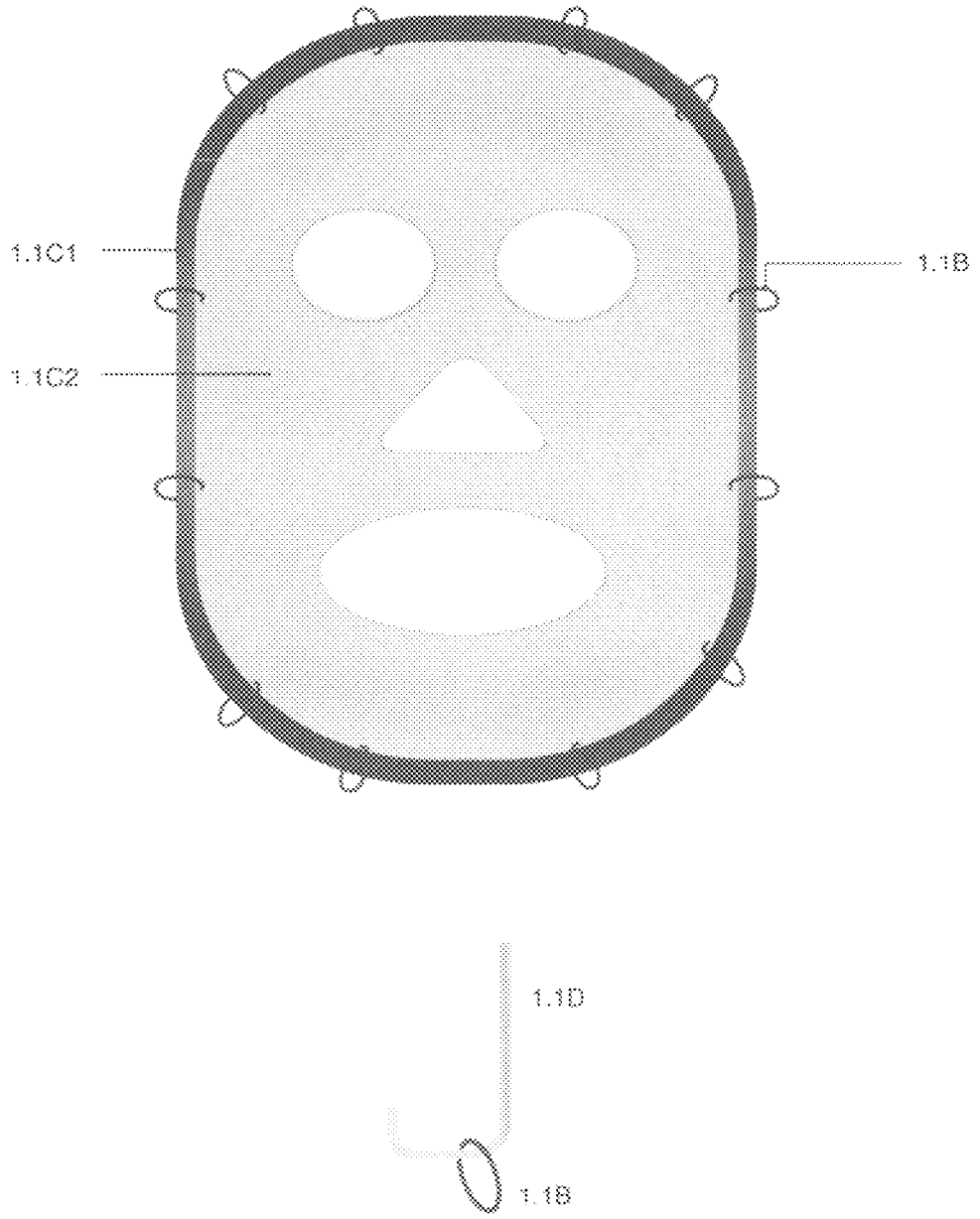
FIG. 3: Is an expanded view of the flexible, strong and smooth fabric neoprene-like layer with cut outs suspending and cradling the face with a plurality of hooks and loops and its sanitary cover would match the cut outs and exact hook and loops for the hammock for the purpose of hygiene in accordance with State laws in the field of massage therapy.
Figure 4:
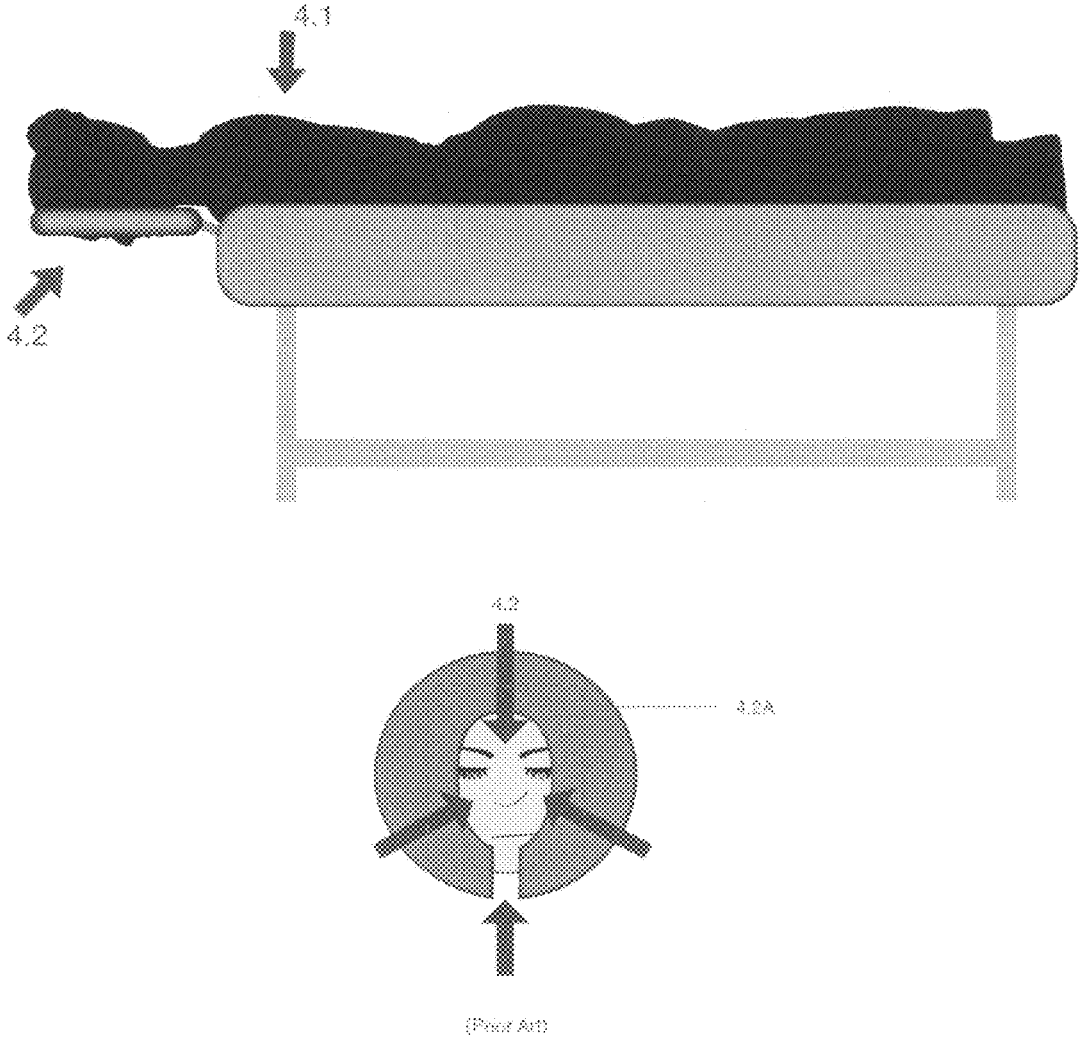
FIG. 4: Labeled as Prior Art demonstrates the problem in methods for massage face rests in the current marketplace; wood frame with padded cushion.
Figure 5:
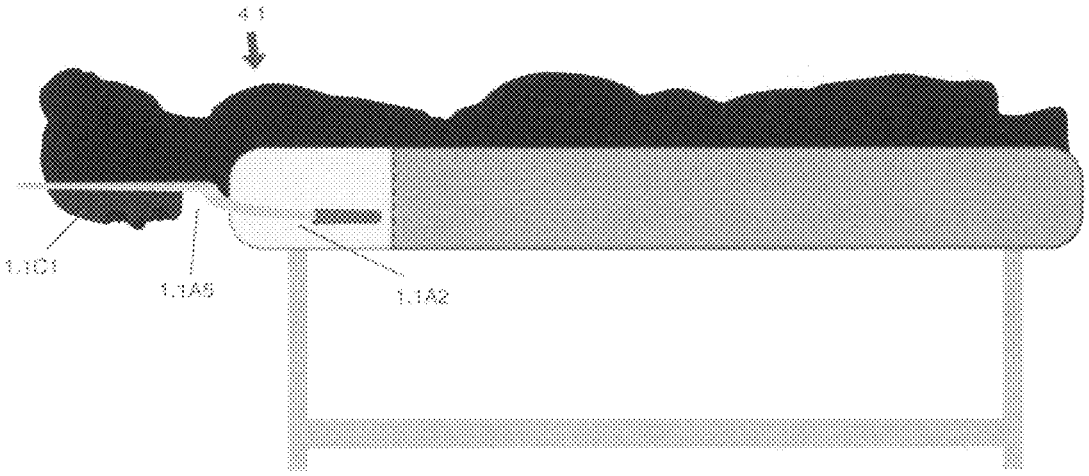
FIG. 5: Is a side view of the Pressure Free Face rest further comprising support and protection from unnecessary said structures in prior art transferring into the face of client; as in weight transference into the longer rod ends below table of the massage therapist as it rests in place.

A Pressure Free Face Rest viewed in FIG. 1 is of a person's face in a prone position on massage therapy/spa table; comprising a C-shaped open frame, element 1.1A1; a light weight, strong, durable and flexible rod made of aluminum, titanium or fiberglass but not limited to which helps to distribute weight/pressure transference from massage therapist as seen in Prior Art and FIG. 5, element 4.1 into the frame thus C-shaped open frame material flexes like that of a fishing pole. C-shaped frame opens toward massage therapy/spa table with two long rod ends, element 1.1A2 inserting into table holes for suspension of person's face, element 1.1C1, having an inner and outer periphery wherein the flexible face mask-shaped hammock is positioned with in the inner periphery and small bungee/elastic loops element 1.1B coupled with a plurality of hooks element 1.1D are evenly spaced in upper surface around underside portion of frame connecting the two elemental structures to hold said hammock in place. Hammock suspension is created by the use of the Pressure Free Face Rest as seen in FIG. 5 where there is no frame under the structures of the bony arch at the outer border of the eye socket, formed by the union of the cheekbone and the zygomatic process of the temporal bone, forehead or chin like that in Prior Art, where elements show 4.2 and 4.2A undesirable pressure. The flexible face-mask shaped hammock may be manufactured in varying sizes to accommodate different sized faces. Inserts rods labeled element 1.1A2 comprise a bend/curve feature shown in FIG. 3, element 1.1A5 in FIG. 2 featuring an upward angle in the segment of its bilateral tension rods to further disperse 20-50 pounds of pressure element 4.1 from therapist into person's back in a prone position seen in both FIGS. 4 and 5. Said Pressure Free Face Rest further comprising a minimum of two layers: the suspension hammock 1.1C1 and washable/disposable sanitary cover/barrier labeled 1.1C2. Said insert rods have approximately three different settings adjustable with slide and snap locks for varying neck lengths as seen in FIG. 1 element 1.1A3. Pressure Free Face Rest further comprising a perpendicular stabilizing support bar, element 1.1E is placed up against table openings where said insert rods are inserted. Element 1.1F further shows placement of stabilizing bracket as to avoid the chin as well as prevent the rods from moving apart when pressure is applied. Element 1.1A4 shows thimble stress relievers with one flat end pressing flat up against the underneath of the massage therapy table for frame counter balance, stability, weight transference and further extends the life of the light weight wood used in Prior Art. Said pressure free face rest device will be manufactured to fit table openings and replace standard models of current face rest frame and apparatus in Prior Art.

The invention claimed is:

1. A Pressure Free Face Rest which is designed to comfortably form around and suspend a person's face during a prone portion of a massage therapy/spa treatment, comprising: a soft but flexible dual layered face mask-shaped hammock to alleviate discomfort, pain, pressure and sinus congestion during a massage therapy/spa treatment; a light weight flexible C-shaped frame open towards the table, comprising of two long insert rods having a contoured upward angle for insertion into openings formed in the massage therapy/spa table, the frame further comprising an inner and outer periphery to hold the person's face free of hard materials; a plurality of hooks connected to an underside of the frame; and a plurality of loops evenly spaced and attached to the periphery of the flexible face mask-shaped hammock and connected to the plurality of hooks, to attach the flexible dual layered face mask-shaped hammock within the inner periphery of the frame to suspend a person's face comfortably.

2. A Pressure Free Face Rest as recited in claim 1, further comprising: at least one extra layer, sanitary cover or face crease/mark reducing barrier for placement between the face mask-shaped hammock in the frame and the person's face utilizing the same plurality of loops equaling the plurality of loops of the flexible dual layered face mask-shaped hammock and made of a soft and smooth material for a less confined feeling, thereby eliminating any markings or face creases.

3. A Pressure Free Face Rest as recited in claim 1, wherein the insert rods lift the flexible dual layered face mask-shaped hammock to the level of said massage therapy/spa table for the purpose of suspending the person's face in a desired anatomical position.

4. A Pressure Free Face Rest as recited in claim 1, further comprising a thimble on each end of the insert rods, each thimble having a long flat top surface contacting the massage therapy/spa table to further minimize cracking and to distribute weight creating a longer life for the massage therapy/spa table.

5. A Pressure Free Face Rest as recited in claim 1, further comprising a stabilizing insert rod support bar extending between the two long insert rods and positioned up against the massage therapy/spa table.

* * * * *